United States Patent [19]

Neuenschwander

[11] Patent Number: 4,591,732

[45] Date of Patent: May 27, 1986

[54] SAFETY RECEPTACLE

[75] Inventor: Ernst Neuenschwander, Männedorf, Switzerland

[73] Assignee: Volpi AG, Urdorf, Switzerland

[21] Appl. No.: 699,826

[22] Filed: Feb. 8, 1985

[30] Foreign Application Priority Data

Feb. 10, 1984 [CH] Switzerland ..... 638/84

[51] Int. Cl.[4] ..... H01H 9/54

[52] U.S. Cl. ..... 307/140; 200/51 R

[58] Field of Search ..... 361/173, 1, 58; 340/638, 652; 307/140, 116, 117, 326, 328; 200/51 R

[56] References Cited

U.S. PATENT DOCUMENTS

| | | | |
|---|---|---|---|
| 2,487,560 | 11/1949 | Kühn | 200/51 R |
| 3,159,725 | 12/1964 | Dennis | 200/51 R |
| 3,775,726 | 11/1973 | Gress | 200/51 R X |
| 3,868,160 | 2/1975 | Kersman | 200/51 R X |

*Primary Examiner*—William M. Shoop, Jr.
*Assistant Examiner*—Al Hoyte
*Attorney, Agent, or Firm*—Handal & Morofsky

[57] ABSTRACT

A safety receptacle or contact system for use at the outlet end of an electric supply line and for connection of at least one attachment plug that has at least two contact pins; the receptacle comprises a base plate; at least two connector ends supported by the base plate; a lid or cover housing including a front plate having at least two openings for receiving the plug pins and for guiding them into contact with the connector ends; an electrical circuit associated with the receptacle for controlled connection of the connector ends with the electric supply line and comprising a relay for breaking contact between the connector ends and the supply line when the two plug pins are withdrawn from the receptacle; and a light barrier connected with the relay for control thereof and arranged for operation in response to connection or non-connection of the plug with the receptacle.

14 Claims, 6 Drawing Figures

SAFETY RECEPTACLE

BACKGROUND OF THE INVENTION

The present invention generally relates to electric distribution and specifically to convenience outlets having a new and improved safety receptacle, i.e. a contact system installed at an outlet of electricity for connection of at least one attachment plug having at least two contact pins and being of the general type used for supply of electricity, e.g. at 110 or 220 Volts, to portable equipment, such as lamps, appliances, electronic equipment, tools, machines, instruments, etc., at currents of typically up to 10 Amperes.

As is well known, conventional receptacles including wall sockets and flush sockets represent a constant source of danger, notably in a household with children, and the art is replete with suggestions of safety devices or safety receptacles.

The general definition of a safety receptacle is that it is made to prevent an unintended or accidental contact of the human body, e.g. the hand of a playing child, with any live parts of the socket. Substantially all types of receptacles or sockets include a lid or cover housing that conceals the live or potentially live parts which are accessible to the pins of a plug through openings of the front plate which is part of the cover housing or of the lid; while the openings have diameters of generally less than 5 mm and are too small to permit penetration by a child's finger, there is always the danger that the child may hold a small metal piece, e.g. a nail or needle, and tries to explore a socket in this manner. Further, when a plug is pulled from a socket by a child or a careless adult there is some danger that the hand which holds the plug while pulling will accidentally touch a part of a contact pin while the latter is still in contact with a live connector end of the receptacle or socket.

In essence, there are two groups of safety receptacles that aim at preventing such unintended body contact with live parts of the receptacle and/or a plug: the first group includes an entirely mechanical (that is, no switching of currents being involved) safety device in the form of a movable safety plate arranged behind the front plate, i.e. within the receptacle and resiliently held, e.g. by a spring, in a monostable "closing" position in which it intersects with the (theoretical) lines of pin movement between the perforations of the front plate and the connector ends. The safety plate or bar either has a wedged cross-section, or is provided with a bevelled edge or taper, and is moveably supported such that it will move out of intersection with the lines of pin movement only upon simultaneous introduction of the contact pins of the plug. Such movement of the safety plate or bar from its stable first or closing position into an "instable", i.e. self-reverting second or access-permitting open position, is generally perpendicular to the line (or lines) of pin movement and the safety plate will return by the action of its spring loading as soon as the plug is withdrawn.

In another group of safety devices a moveable plate or bar of the type just discussed is combined with an electrical safety device incorporating the basic features of a relay, i.e. an electric device designed to interpret certain input conditions in a predetermined manner and to respond to predetermined conditions by causing an abrupt electric change, e.g. making or breaking an electric circuit.

In prior art safety receptacles the relay responds to a switch that is operated by the moveable safety plate or bar and switches the energizing current of the relay which, in turn, connects the electric supply line with at least one connector end of the receptacle.

A main disadvantage of the simple or purely mechanical safety receptacles is that the safety plate or bar must be moveable across substantially the entire contact diameter of the connector ends; in practice this amounts to a displacement length of at least about 5 mm taking into account the normal configuration of the pin-receiving portion of the contact ends with their outwardly curved prong ends. Displacement of the safety plate along a path of such length in response to the pressure of the plug pins acting upon the safety plate at an angle of about 90° will be felt as a substantial hindrance to normal plug insertion. The user will be caused or tempted to use excessive force when pushing a plug into such a receptacle and this may easily lead to damages of the receptacle which, in general, is a low-cost mass produced item.

Receptacles that include an electric safety device share this defect to some extent at least. While the safety plate of such receptacles need not cover the entire cross-section of the pin contacting portion of the connector ends, the required length of displacement must still be large enough to actuate the switch for the operating circuit of the relay; the space requirements of the relay switch and the relay proper constitute another disadvantage of such receptacles that tend to be more bulky than normal receptacles and require a larger volume of space for mounting.

SUMMARY OF THE INVENTION

Hence, it is a primary object of the present invention to provide a new and improved construction of a safety receptacle or contact system which is not afflicted with the aforementioned drawbacks and limitations of prior art constructions.

Another important object of the present invention is to provide a new and improved construction of a safety receptacle in which at least the live connector end is not in contact with it's feeding electric supply line as long as not all, or both, pins of an attachment plug have been introduced into the receptacle.

A further important object of the present invention aims at providing a new and improved construction of a safety receptacle wherein insertion of a plug is substantially unencumbered by the safety features.

Yet a further feature of the present invention is directed at a safety receptacle wherein the features needed for safe and simple operation do not require more space than is available within a receptacle of conventional construction and having no other safety features except the external lid or cover housing and the ordinary restricted openings in the front plate thereof.

Now, in order to implement these and still other objects, which will become more readily apparent as the description proceeds, the safety receptacle or contact system according to the invention for use at an outlet end of an electric supply line and for connection of at least one attachment plug having at least two contact pins will essentially comprise:

A base plate that may have a conventional structure and may consist of any suitable prior art material, e.g. an insulator, such as a ceramic material; at least two connector ends supported by said base plate, e.g. in a manner known per se; an external lid or cover housing, generally made of an insulating material, e.g. a thermoset plastic material, and including a front plate, e.g. of the same material as the lid or housing, having at least two openings for receiving the pins of a plug and for guiding the pins into contact with the connector ends; the front plate may be an integral part of the lid or housing, or may be a separate part connected thereto in a manner known per se, e.g. by means of a screw; an electrical circuit is associated with the receptacle for controlled connection of at least the live connector end with the supply line and comprises a relay for breaking contact between the live connector end, at least, and the supply line when the plug pins are withdrawn from the receptacle; according to a general embodiment of the invention a light barrier means or system is connected with the relay for switching control thereof and is arranged for operation in response to connection of the plug with the receptacle.

Preferably, a (theoretical) line of pin movement is defined between each front plate opening and the connector end associated therewith. Further, according to this preferred embodiment, the light barrier will maintain said relay in a contact breaking position when in at-rest position, i.e. in the absence of plug pins, and will operate the relay for connection of the connector end with the supply line only when the contact pins are moved simultaneously along the theoretical line of pin movement into contact with the connector end.

As will be explained in more detail below, the light barrier means for a receptacle according to the invention may be free of any moveable mechanical elements; alternatively, the light barrier may include an elongated solid element that comprises a light transmitting path and is capable to be moved between a non-transmitting position and a transmitting position, e.g. aligned between a light emitter and a receptor or extensions thereof, e.g. in the form of solid optical conductors as explained in more detail below.

Light barrier systems are known per se, of course, and generally include a light source or emitter, a light sensor or receptor (e.g. a photoelectric cell or other type of transducer that generates an electrical signal in response to impinging light) and a predetermined light path between the light emitter and the receptor; this predetermined path includes, or consists of, the actual barrier (also termed "gate" or "barrier portion") which, when established or when breached, actuates a change, i.e. either the generation of an electric current by the receptor or the interruption of a current, and both generation and interruption may be used according to the invention for controlling the position of the relay such as to make or break the contact between the electric supply line and the live connector end of the receptacle. As will be apparent, the electrical signal generated by the receptor may be amplified in a conventional manner for producing the relay-operating signal.

When the barrier portion, or portions, constitutes or constitute substantially the entire optical path of the light barrier means the light emitter and the receptor will be positioned at the respective opposite ends of the barrier portion; in this case, both the emitter and the receptor will be arranged within the receptacle according to the invention and commercially available semiconductor elements can be employed for use as emitters and receptors.

Alternatively, the emitter and/or the receptor may be arranged at a distance from the respective opposite end of the barrier portion; in that case, the predetermined optical path of the light barrier means of a safety receptacle according to the invention will include a generally solid optical conductor, preferably an optical fibre made of inorganic or organic transparent substance (e.g. a glass) or a bundle of such fibres to connect the emitter and/or receptor with the respective opposite ends of the barrier portion.

The barrier means of a receptacle according to the invention may include only one, or a plurality of barriers (barrier portions); for example, one barrier portion may be sufficient for causing the relay to make or break contact between the live connector end, or ends, and the electric supply line in response to presence or absence of plug pins, or a separate barrier portion may be used in association with any live, or potentially live, connector end provided within a receptacle according to the invention.

It will be appreciated that the actual direction of the light caused to pass through the predetermined optical path of the light barrier means in a receptacle according to the invention is not of essence; consequently, the relative position of emitter/receptor at one or the other of the opposite ends of the predetermined optical path is a matter of convenience.

By the same token, the function of the end of an optical conductor at the adjacent end of a barrier or barrier portion is a matter of convenience as well. Accordingly, the term "light emitter/receptor end" refers to the light emitting or light receiving end provided at one respective end of a barrier portion, and such "light emitter/receptor end" may be either the actual emitter and/or receptor or the end of a solid optical conductor arranged between emitter and/or receptor and the barrier portion.

As indicated above, the barrier portion may be a physical structure, such as a bar or other elongated element termed a "bridge" herein; preferably, such a bridge for use in the present invention is "monostable" in the sense that it can be moved in a self-returning manner from a first or rest position into a second or actuating position; preferably, such movement will be caused only upon introduction of the plug pins, while return of the bridge into its first position will be effected by spring means that push or pull the bridge into rest position as soon as the plug pins are withdrawn from the receptacle.

The bridge has a light path which may be a recess, bore or the like linear channel, or a solid optical conductor, e.g. optical fibre or bundle, in which latter case the path may but need not be linear.

In its first or rest position the bridge may be in light transmitting or in non-transmitting position depending upon the associated electrical circuit and in either case the connection between the electric supply line and the connector end(s) will be broken by the relay. Also in either case, connection between the supply line and the connector end(s) will be established only when the bridge is in second or actuating position.

Generally, some mechanical guide means are provided to limit bridge movement between first and second position and to prevent displacement from the first position by introduction of anything but the plug pins. In this context, it may be preferred to arrange the optical path within the bridge such that only a substantially perfect alignment of the path ends between a light emitter and a light receptor will cause actuation, i.e. supply of electricity to the connector end(s).

BRIEF DISCUSSION OF THE DRAWINGS

The invention will be better understood and objects other than those set forth above will become apparent when consideration is given to the following detailed description thereof. Such description makes reference to the annexed drawings which illustrate preferred exemplary embodiments of the invention and wherein:

FIG. 1*a* is a schematic top-view of the base plate of a safety receptacle according to the invention where the barrier means comprise a moveable bridge element;

FIG. 1*b* is a side-view of the base plate of FIG. 1*a;*

DETAILED DESCRIPTION OF THE PREFERRED EMBODIMENTS

Figure 1A:
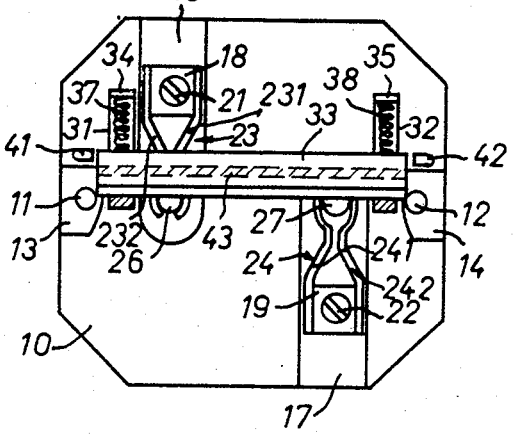

Base plate 10 shown in a semi-diagrammatical top-view (FIG. 1*a*) and side-view (FIG. 1*b*) is depicted merely for better illustration at a somewhat enlarged scale of about 1.5:1 in relation to typical dimensions of standardized sockets and standard plugs or standard pin-receiving connector ends. Plate 10 consists of an electrically insulating material, such as a ceramic, and serves to secure the receptacle in or on the wall of a building, panel or the like and to hold the components of the receptacle. Generally, base plate 10 comprises bores 11, 12 or similar perforations that open into enlarged recesses 13, 14 at the upper surface of base plate 10 and are intended for mounting of base plate 10 at a wall or panel, e.g. by means of screws (not shown). Base plate 10 includes two further recesses 16, 17 where the connector ends 18, 19 are inserted and secured.

Such connector ends, also termed "socket connector" or just "connectors", are conventional to the extent of being standardized, and include each a mounting end 18, 19 where each connector 23, 24 is attached to the base plate 10 (in a manner not shown) and carries a screw 21, 22 for connection of a lead (not shown) or connecting wire from an electric supply line (not shown); normally, the line will be a two-wire line (live wire and neutral wire) or a three-wire line (live wire, neutral wire and ground wire) operating at a typical AC-voltage of 220 Volts.

Figure 1B:
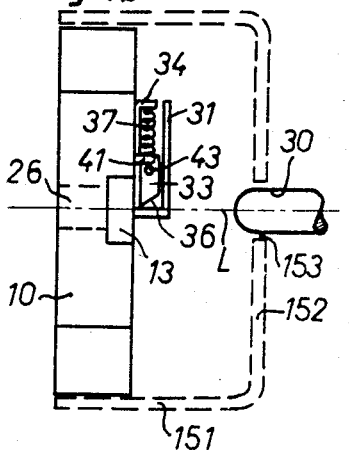

Each connector end 23, 24 includes a pair of resilient arms or prongs 231, 232; 241, 242, extending from each mounting end 18, 19 to a bag hole or bore 26, 27 in base plate 10; as indicated in broken lines in FIG. 1*b,* contact pins 30 (only one pin shown) of a plug will be moved along a line L of pin movement (dash-dotted line) guided by opening 153 (only one shown in FIG. 1*b*) in front plate 152 of cover housing 151 into or from the corresponding bore (26, shown in FIG. 1*b*) for connection with, or disconnection from, the pin receiving end of the corresponding connector end (omitted in FIG. 1*b* for clarity) that surrounds the corresponding bore in base plate 10.

In this context, it will be understood that the actual form of cover housing 151 and front plate 152 will depend upon whether the receptacle is of the flush type or of the protruding type since the mounting recess that is normally provided in a wall or panel where the flush-mounted receptacle is arranged may form the side portion 151 of the receptacle housing; in that case, front plate 152 would normally be a central insert of a flush cover plate secured at the outward end of the wall-mounting recess (not shown in FIG. 1*b*).

As is apparent from FIG. 1*b,* pin 30 will contact the below explained bridge element 33 when inserted by movement along line L of pin movement and actuate the light barrier means just before contact with the connector end upon insertion, or just after disconnection from the connector end upon withdrawal.

U-shaped guide rails 31, 32 are mounted on the upper face of base plate 10 for guiding a bar or bridge element 33 between the first (at rest) position shown in FIGS. 1*a,* 1*b* and a second actuating position (not shown) resulting from insertion of the contact pins 30 of a plug. The distance between the inner surfaces of the legs of guide rails 31, 32 and the adjacent surfaces of the bridge element 33 are selected such that the latter can be displaced smoothly.

The free end 34, 35 of one leg of guide rail 32, 32 is bent or offset to support one end of a pressure spring 37, 38 that engages bridge 33 and holds the latter in its first or self-returning (monostable) at rest position.

Side face 36 of bridge 33 is beveled to include an angle of typically about 30° with line L of pin movement. Generally, bridge 33 will be dimensioned and arranged such that it will cover about half of the diameters of holes 26, 27 when in at rest position.

Arranged adjacent the longitudinal ends of bridge 33 are ends 41, 42 of two optical conductors, e.g. monofilaments having a diameter of less than about 0.5 mm. These monofilaments are secured at their ends for permanent positioning, e.g. by means of a bore (not shown) in base plate 10. Bridge 33 includes a channel or bore extending through its length from one end to the other, and a discrete portion of an optical conductor 43, preferably another monofilament, is inserted into such channel. The relative positions of ends 41, 42 of the optical conductors and the end faces of optical conductor 43 within bridge element 33 are arranged in the offset position shown in FIGS. 1*a* and 1*b*. In this at rest position the optical path of the light barrier means is interrupted, or "open".

Figure 2:
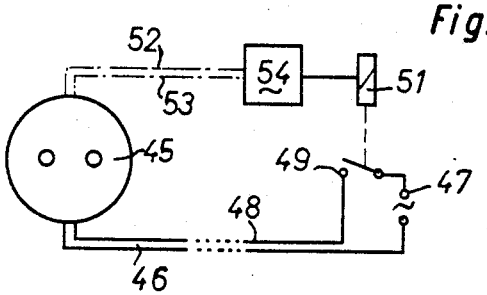
FIG. 2 is a schematic presentation of a safety receptacle combined with optical conductors controlling a relay in the electric supply line of the receptacle.
Figure 3:
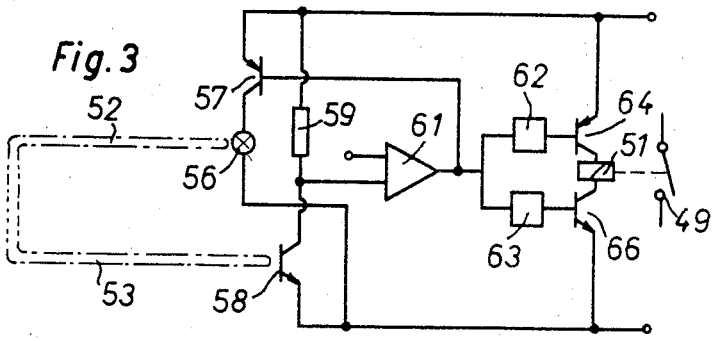
FIG. 3 is a block diagram of an amplifier circuit that controls a relay in conformity with an optical input signal.

The operation of an inventive safety receptacle or safety contact system will be apparent from FIGS. 2 and 3 where the receptacle 45 shown diagrammatically includes one connector end (not shown) which is connected by lead 46 directly with the neutral wire of a source of electric current; the other connector end of receptacle 45 is connected by lead 48 via the paired contact 49 of relay 51 with the live wire 47 of the electric current source. Two optical conductors 52, 53 (the ends 41, 42 of which have been described above in connection with FIGS. 1*a,* 1*b*) extend from receptacle 45 to an electronic amplifier circuit 54 having an output end which is connected with the actuator coil of relay 51. In other words, control signals produced by the optical conductors will control relay 51 so as to connect, or disconnect, the live wire 47 with, or from, receptacle 45.

FIG. 3 illustrates an example of an electronic amplifier circuit for a self-controlling light barrier means for use with a receptacle according to the invention. The amplifier circuit shown includes a light source 56, e.g. a light-emitting diode or LED, connected in series with a control transistor 57. A photoelectric element 58, for example a photo diode, is connected in series with resistor 59. The lead from the photo diode 58 to the serial resistor 59 is connected with one input end of an amplifier 61; the other input end of amplifier 61 is connected with a source of a reference potential. A first lead from the output end of this amplifier is connected with the basis of control transistor 57 while a second branched lead is connected with two monostable multivibrators 62, 63. The output end of each multivibrator is connected with the base of an associated transistor 64, 66 connected in series with relay 51, i.e. the actuating coil thereof.

Amplifier circuits of this type are well known per se in the art so that a more detailed description of their elements or their connection is not required; also, operation of such amplifier circuits is well known; it will be noted, however, that light source 56 is illuminated when no light is conducted to photo diode 58, and that relay 51 will not be actuated when the photo diode is not illuminated so that relay contact 49 will not be closed. When the light path from light source 56 to photo diode 58 is not interrupted an oscillator circuit will be formed by photo diode 58, amplifier 61 and transistor 57 together with light source 56; the frequency of oscillation will depend upon the specific elements used in a manner well known per se and will cause intermittent illumination of the light source. The oscillating oscillator drives the monostable multivibrator 62, 63 which actuate the coil of relay 51 via transistors 64 and 66; the relay is thus closed by contacts 49.

When no plug is inserted into the safety receptacle or safety contact system of this embodiment, i.e. when no contact pins are introduced into the connector ends, bridge 33 shown in FIGS. 1*a*, 1*b* will be pressed by springs 37, 38 against the connecting portions of the two legs of guide rails 31, 32; consequently, the optical conductor 43 of bridge 33 is offset against ends 41, 42 of the light conductors 52, 53 as depicted in FIGS. 1*a* and 1*b*. Thus, the light path between light source 56 and photo diode 58 is interrupted so that the light source will be illuminated continuously while relay 51 is not actuated and contact pair 49 is open; as a consequence, the live connector end, i.e. the connector end that is connected with the live wire of the electric supply line, is disconnected from the live wire. Now, if only one pin or any other instrument would be introduced into one of the connector ends 23 or 24 that part of bridge 33 which is adjacent to that one connector end will be moved against the pressure of the associated spring 37, 38. While the other end face of light conductor 43 within bridge 33 with its adjacent end 41, 42 might become aligned with one of the light conductors, the other end face will remain in offset position relative to the adjacent end of the light conductor.

As a consequence, it will not be possible to align both end faces of light conductor 43 of bridge 33 with the adjacent ends of the optical conductors associated with emitter/receptor of the light barrier means so that the receptacle will not be connected with the live wire if only one contact pin or another elongated element is introduced into the receptacle. By the same token, connection of the safety receptacle with the electric supply line, or its live portion, will be prevented when two plugs are introduced simultaneously into the receptacle and the connector ends thereof as long as the diameters of the pins are too small or too large.

Upon introduction of a plug that has contact pins of the required diameter into the receptacle, i.e. between the arms 231, 232; 241, 242 of connector ends 23, 24, the leading end of each contact pin 30 will slide along the beveled face 36 of bridge 33 so that the latter will be displaced against the pressure of springs 37, 38 from the first or at rest position into the second or actuating position where both end faces of optical conductor 43 within bridge 33 are aligned with ends 41, 42 of light conductors 52, 53 associated with emitter 56/receptor 58 (FIGS. 2 and 3). Thus, an uninterrupted light path is formed between light source 56 and photo diode 58 so that the latter is illuminated. Then, the input part of amplifier circuit (FIG. 3) will start to oscillate as explained above so that the coil of relay 51 will be actuated and the paired contact 49 thereof will be closed to the effect that the connector ends of the receptacle will be connected with the electric supply line.

As will be understood without a more detailed discussion, bridge 33 will return into its first or at rest position upon withdrawal of the plug from the receptacle so that the connection of at least the live connector end with the live wire of the electric supply line will be interrupted.

Figure 4:
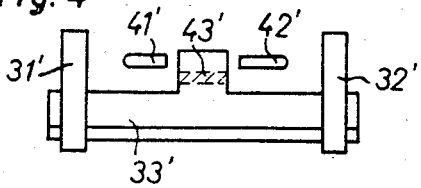
FIG. 4 is a schematic top-view of a preferred embodiment of the bridge element.

Obviously, this embodiment of the inventive safety receptacle can be modified in various ways and adapted to different specific uses or operating conditions. For example, a third connector end may be provided having a permanent connection with the ' ground wire of the supply line. Further, the bridge 33 (shown in FIGS. 1*a* and 1*b*) having an optical conductor 43 that extends substantially over the entire length of bridge 33 could be replaced —as shown in FIG. 4—by a T-shaped bridge 33' having a relatively short optical conductor 43' in the stem portion of this element (FIG. 4). It should be noted, however, that the degree of safety against unintended connection of the receptacle with the electric supply line will, in general, increase with the length of the light conductor that is arranged within the moveable bridge element of the light barrier means. Further, it will be understood that the sensitivity of this embodiment of the light barrier means may be substantially increased by the use of optically different materials for the optical conductor of the bridge and the optical conductors between the bridge and the emitter/-receptor constituents of the amplifier circuit; such different materials can be selected advantageously for having different angles of aperture so that a very precise alignment of the ends of the light conductors is required for transmission of sufficient light to effect oscillating actuation of the amplifier circuit. Further, it will be understood that the light conductors need not be monofilaments of the type mentioned above but may be fiber bundles; also the effects discussed above will be achieved regardless of whether the material of the optical conductors or fibers is mineral glass (e.g. silicaceous), quartz or a transparent organic polymer.

As mentioned above, use of a displaceable physical element or bridge is not a critical requirement of a light barrier means suitable for the invention. In fact, another preferred embodiment of the invention provides for a safety receptacle that requires no motion of component bodies as will be explained below in connection with FIG. 5.

Figure 5:
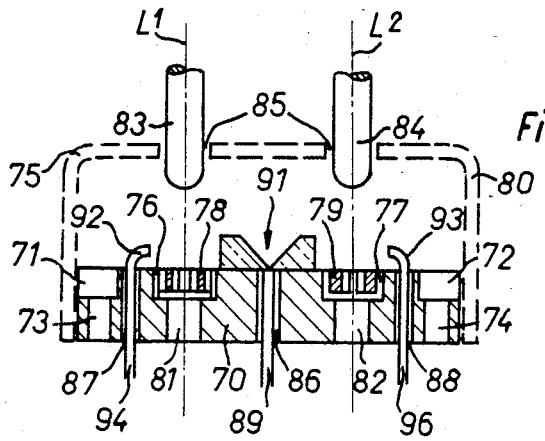
FIG. 5 is a schematic sectional view of another embodiment of the safety receptacle according to the invention including two barrier portions that are operated by the contact pins of the plug.

Again, as explained for FIGS. 1*a*, 1*b*, the base plate 70 is combined with a lid or cover housing and a front plate which, in FIG. 5, is depicted schematically by a housing constituent 75 (which may be the wall of a mounting recess for flush receptacles) and a front plate 80 that has openings 85 for guiding pins 83, 84 of an attachment plug (not shown) along lines $L^1$, $L^2$ of pin movement into electrical contact with or out of electrical contact from connector ends 78, 79.

Base plate 70 of the safety receptacle according to the invention as depicted in FIG. 5 is shown in section having recesses 71, 72 with bores 73, 74 for securing the base plate at a mounting site as explained above for FIGS. 1*a*, 1*b*. Also, base plate 70 includes recesses 76, 77 for inserting the connector ends 79, 78 (only the pin-contacting portion being shown) and, again, bores or bag holes 81, 82 are provided to receive a tip portion of contact pins 83, 84. Base plate 70 further includes a central passage 86 and two off-center passages 87, 88 for receiving optical conductors 89, 94 and 96. The end part of the central conductor 89 is cemented to the base of a double prism 91 arranged at the upper side of base plate 70. The ends 92, 93 of optical conductors 94, 96 are bent toward double prism 91 so as to form two gates or light barriers, one between emitter/receptor end 92 of optical conductor 94 and the adjacent face of double prism 91 (which serves as the complementary receptor/emitter end) and the other between emitter/receptor 93 of optical conductor 96 and the adjacent face of double prism 91. It will be understood that when the double prism 91 is at the end of a single optical conductor, such as 89 in FIG. 5, both faces of the double prism will be either light emitter or receptor ends so that the ends 92, 93 of optical conductors would both be either light receptors or emitter ends. Other arrangements are possible, of course, and the use of a double prism at the end of a single optical conductor, while preferred for practical purposes, is not a critical feature.

Preferably, the electronic amplifier for use with the light barrier means of FIG. 5 will be modified such that the relay 51 will be actuated only when the light path of both gates or light barrier portions is interrupted by the tips of contact pins 83, 84. Further modifications of amplifier circuits for operation with the embodiment of the inventive safety receptacle shown in FIG. 5 will be apparent from the explanation given above in connection with FIGS. 2 and 3. The main modification required is that the optical conductor 52 and/or 53 of FIG. 2 and 3 must include at least two discrete lines so as to be capable of forming separate emitter/receptor ends 92, 93.

In addition, the electronic amplifier will be modified such that the actuating coil of relay 51 will be energized only then when both gates or light barrier sections (first gate or barrier portion between end 92 and prism 91; second gate or barrier portion between end 93 and prism 91) are interrupted.

These and other modifications of circuitry are believed to be within the ordinary skill so that no further explanation is deemed to be required.

Generally, in a safety receptacle according to the invention, all elements required for the light barrier means can be arranged within the receptacle without increase of the receptacle volume; no mechanically operating switch for control of the relay position is needed so that prolonged safe operation can be achieved; in this respect, the embodiment of the invention illustrated in FIG. 5 is particularly preferred. Another advantage of all embodiments of the inventive safety receptacle resides in the fact that accidental damages of the light barrier means will break the contact of live receptacle components with the electric supply line.

While preferred embodiments of the safety receptacle or safety contact system according to the invention have been shown and described herein, it is distinctly understood that the invention is not limited thereto but may be embodied and practiced within the scope of the following claims.

What I claim is:

1. A safety receptacle or contact system for use at an outlet end of an electric supply line and for connection of at least one attachment plug having at least two contact pins; said receptacle comprising:

a base plate;

at least two connector ends supported by said base plate, at least one of said connector ends being a live connector end;

a lid or cover housing including:

a front plate having at least two openings for receiving said pins of said plug and for guiding said pins into contact with said connector ends;

an electrical circuit associated with said receptacle for controlled connection of said connector ends with said supply line comprising:

a relay for making and breaking electric contact between said connector ends and said supply line in response to predetermined signals; and a light barrier means connected with said relay for transmission of said predetermined signals and arranged to cause breaking of said electric contact between said at least one live connector end and said supply line when said pins of said plug are withdrawn from said at least two openings, and to cause making of said electric contact between said at least one live connector end and said supply line only when said pins of said plug are inserted into said at least two openings and approach said at least two connector ends.

2. The receptacle of claim 1, wherein one line of pin movement each is defined between one of said openings and one of said connector ends; and wherein said light barrier means is arranged to maintain said relay in a contact breaking state when in at rest position in the absence of an attachment plug and to produce a predetermined signal for causing said relay to make electric contact between said at least one live connector and said supply line only when all pins of said plug are moved substantially simultaneously along said lines of pin movement into contact with said connector ends.

3. The receptacle of claim 1, wherein said light barrier means include two barrier portions, each of which is associated with one of said connector ends and arranged between its associated connector end and one of said to openings so as to operate said relay for connection of said supply line with said connector ends only when contact pins of an attachment plug are moved substantially simultaneously toward, and into contact with, said connector ends.

4. The receptacle of claim 3, wherein each of said two light barrier portions includes one separate light emitter/receptor end and wherein a double-ended light emitter/receptor in the form of a double prism is provided between said two light barrier portions.

5. The receptacle of claim 2, wherein said light barrier means include a monostable bridge element capable of guided movement between a first or rest position and a second or actuating position; said element in said first position being positioned to be contacted by said pin when moving along said line of pin movement.

6. The receptacle of claim 5 comprising means for guided displacement of said bridge element from said first into said second position when two pins are moved simultaneously along said lines of pin movement but preventing such displacement as long as a major portion, at least, of one of said lines of pin movement is unoccupied.

7. The receptacle of claim 1, wherein said light barrier means includes at least one light emitter and at least one light receptor, said emitter and receptor being respective end faces of optical conductors extending from within said receptacle to a light source and a light sensor arranged outside of said receptacle.

8. The receptacle of claim 1, wherein said light barrier means includes at least one light emitter and at least one light receptor, said emitter and receptor being semiconductor elements arranged within said receptacle.

9. The receptacle of claim 2, wherein said light barrier means includes at least one light emitter and at least one light receptor, said light receptor including a photoelectric transducer connected to an amplifier capable of generating a signal for said control of said relay.

10. The receptacle of claim 5, wherein said bridge element includes a solid optical conductor aligned between a light emitter and a light receptor when in said second or actuating position.

11. The receptacle of claim 7, wherein said optical conductor is a bundle of optical fibers.

12. The receptacle of claim 10, wherein said solid optical conductor is a bundle of optical fibers.

13. The receptacle of claim 5 including two guide means, each arranged near an end of said bridge and including a substantially U-shaped guide rail secured to said base plate and a spring means to engage said bridge element and maintaining same in its first or rest position as long as no plug is introduced into said receptacle.

14. The receptacle of claim 6, wherein said guide means each include a substantially U-shaped guide rail secured to said base plate and a spring means to resiliently maintain said bridge in said first or rest position as long as no plug is introduced into said receptacle.

* * * * *